US009384607B1

(12) United States Patent
Copeland et al.

(10) Patent No.: US 9,384,607 B1
(45) Date of Patent: Jul. 5, 2016

(54) ACCESS CONTROL SYSTEM

(71) Applicants: Richard L. Copeland, Lake Worth, FL (US); Melwyn F. Sequeira, Plantation, FL (US); Mohammad Mohiuddin, Boynton Beach, FL (US)

(72) Inventors: Richard L. Copeland, Lake Worth, FL (US); Melwyn F. Sequeira, Plantation, FL (US); Mohammad Mohiuddin, Boynton Beach, FL (US)

(73) Assignee: Tyco Fire & Security GMBH, Neuhausen am Rheinfall (CH)

( * ) Notice: Subject to any disclaimer, the term of this patent is extended or adjusted under 35 U.S.C. 154(b) by 21 days.

(21) Appl. No.: 14/558,796

(22) Filed: Dec. 3, 2014

(51) Int. Cl.
*G07C 9/00* (2006.01)

(52) U.S. Cl.
CPC ..... *G07C 9/00111* (2013.01); *G07C 9/00* (2013.01)

(58) Field of Classification Search
CPC ..... G07C 9/00; G07C 9/00031; G05B 1/01
USPC ..... 340/5.54, 5.61–5.65
See application file for complete search history.

(56) References Cited

U.S. PATENT DOCUMENTS

| | | | | |
|---|---|---|---|---|
| 5,532,705 | A | 7/1996 | Hama | |
| 5,763,868 | A | 6/1998 | Kubota et al. | |
| 5,947,369 | A * | 9/1999 | Frommer | G06K 19/06046 235/380 |
| 6,788,262 | B1 | 9/2004 | Adams et al. | |
| 6,888,502 | B2 | 5/2005 | Beigel et al. | |
| 6,950,098 | B2 * | 9/2005 | Brabander | G02F 1/13318 324/754.23 |
| 7,323,991 | B1 | 1/2008 | Eckert et al. | |
| 7,424,316 | B1 | 9/2008 | Boyle | |
| 7,450,077 | B2 | 11/2008 | Waterhouse et al. | |
| 7,629,934 | B2 | 12/2009 | Rhodes et al. | |
| 7,696,882 | B1 * | 4/2010 | Rahimi | G06Q 10/087 340/505 |
| 7,982,616 | B2 | 7/2011 | Banerjee et al. | |
| 8,267,325 | B2 | 9/2012 | Phaneuf | |
| 8,497,808 | B2 | 7/2013 | Wang | |
| 8,599,101 | B2 | 12/2013 | Christie et al. | |
| 8,646,695 | B2 | 2/2014 | Worrall et al. | |
| 8,674,810 | B2 | 3/2014 | Uysal et al. | |
| 8,917,214 | B2 | 12/2014 | Forster | |

(Continued)

FOREIGN PATENT DOCUMENTS

| | | |
|---|---|---|
| CN | 203825788 | 9/2014 |
| EP | 2330698 B1 | 6/2011 |

(Continued)

OTHER PUBLICATIONS

Rais, N.H.M., et al., "A Review of Wearable Antenna," Antennas & Propagation Conference, 2009, LAPC 2009, Loughborough, Published IEEE; 978-1-4244-2720-8; DOI: 10.1109/LAPC2009.5352373.

(Continued)

*Primary Examiner* — Allen T Cao
(74) *Attorney, Agent, or Firm* — Fox Rothschild LLP; Robert J. Sacco; Carol E. Thorstad-Forsyth

(57) ABSTRACT

Systems (100) and methods (300, 400) for controlling access to a restricted area. The methods involve: determining whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device disposed within the WAS; and causing actuation of a mechanical actuator to enable the person's entrance into or exit from the restricted area when a determination is made that the person desires to enter or exit the restricted area.

20 Claims, 7 Drawing Sheets

(56) References Cited

U.S. PATENT DOCUMENTS

| | | | | |
|---|---|---|---|---|
| 9,076,273 | B2 | 7/2015 | Smith et al. | |
| 2002/0140558 | A1 | 10/2002 | Lian et al. | |
| 2004/0246103 | A1* | 12/2004 | Zukowski | G06F 21/79 340/10.41 |
| 2005/0285740 | A1* | 12/2005 | Kubach | G06Q 10/087 340/572.1 |
| 2006/0219778 | A1* | 10/2006 | Komatsu | H04L 63/0853 235/382 |
| 2007/0182559 | A1 | 8/2007 | Lawrence et al. | |
| 2008/0055045 | A1 | 3/2008 | Swan et al. | |
| 2009/0121931 | A1 | 5/2009 | Katz | |
| 2009/0322513 | A1* | 12/2009 | Hwang | A61B 5/02055 340/539.12 |
| 2010/0315244 | A1* | 12/2010 | Tokhtuev | G06Q 10/00 340/603 |
| 2011/0022121 | A1 | 1/2011 | Meskins | |
| 2011/0148602 | A1* | 6/2011 | Goh | G01S 5/0252 340/10.41 |
| 2011/0316700 | A1* | 12/2011 | Kasahara | G08B 29/185 340/541 |
| 2012/0056719 | A1 | 3/2012 | Krishna et al. | |
| 2012/0234921 | A1 | 9/2012 | Tiedmann et al. | |
| 2012/0242501 | A1* | 9/2012 | Tran | A61B 5/0024 340/870.02 |
| 2012/0286927 | A1* | 11/2012 | Hagl | G07C 9/00309 340/5.61 |
| 2013/0027180 | A1* | 1/2013 | Lakamraju | G07C 9/00087 340/5.53 |
| 2013/0278382 | A1 | 10/2013 | Cristache | |
| 2014/0077929 | A1 | 3/2014 | Dumas et al. | |
| 2014/0159959 | A1 | 6/2014 | Rhoads et al. | |
| 2014/0159975 | A1 | 6/2014 | Apostolos et al. | |
| 2014/0226844 | A1 | 8/2014 | Kerselaers | |
| 2014/0240087 | A1 | 8/2014 | Liu et al. | |
| 2014/0354494 | A1 | 12/2014 | Katz | |
| 2015/0041614 | A1 | 2/2015 | Tran et al. | |
| 2015/0054696 | A1 | 2/2015 | Werner et al. | |
| 2015/0149310 | A1* | 5/2015 | He | G06Q 20/322 705/21 |
| 2015/0221147 | A1* | 8/2015 | Daniel-Wayman | G07C 9/00039 340/5.54 |
| 2015/0264431 | A1 | 9/2015 | Cheng | |
| 2015/0339870 | A1* | 11/2015 | Cojocaru | G07C 9/00039 340/5.53 |
| 2015/0379791 | A1* | 12/2015 | Russell | G07C 9/00031 340/5.61 |
| 2016/0007315 | A1* | 1/2016 | Lundgreen | G01S 3/46 455/67.11 |

FOREIGN PATENT DOCUMENTS

| | | | |
|---|---|---|---|
| EP | 2330968 | B1 | 6/2011 |
| EP | 2495621 | | 9/2012 |
| EP | 2597783 | A2 | 5/2013 |
| WO | 9941721 | A1 | 8/1999 |
| WO | 2014/113882 | A1 | 7/2014 |
| WO | 2014147947 | A1 | 9/2014 |
| WO | 2014/210000 | | 12/2014 |
| WO | 2015/023737 | A1 | 2/2015 |

OTHER PUBLICATIONS

Hall, P.S., et al., "Antennas and Propagation for Body Centric Communications," Proc. 'EUCAP 2006', Nice, France, Nov. 6-10, 2006 (ESA SP-626, Oct. 2006).

Conway, G.A., et al., "Antennas for Over-Body-Surface Communication at 2.45 GHz," IEEE Transactions on Antennas and Propagation, vol. 57, No. 4, Apr. 2009, 0018-926X, copyright 2009 IEEE.

Ito, K., et al., "Wearable Antennas for Body-Centric Wireless Communications," copyright IEEE 2010; 978-1-4244-6418-0/10.

Matthews, J.C.G., et al., "Body Wearable Antennas for UHF/VHF," 2008 Loughborough Antennas & Propagation Conference, 978-1-4244-1894-7/08, copyright 2008 IEEE.

* cited by examiner

ACCESS CONTROL SYSTEM

FIELD OF THE INVENTION

This document relates generally to Access Control Systems ("ACSs") for restricted areas. More particularly, this document relates to ACSs using a wearable access sensor.

BACKGROUND OF THE INVENTION

There are many ACSs known in the art. One such ACS comprises a plurality of Access Control Readers ("ACRs") mounted at exits and/or entries of restricted areas. For example, an ACR may be disposed adjacent to a doorway through which access to a restricted room is gained. A badge worn by a person is used to gain access to a restricted room via the ACR. In this regard, the badge comprises a Low Frequency ("LF") passive Radio Frequency Identifier ("RFID") communication device disposed thereon or therein. The LF passive RFID communication device typically operates at a frequency of 125 kHz. The ACR is a near field device with a detection range of about 5 cm or less. Throughout a given time period, the ACS tracks which entries a given person passes through for purposes of entering a restricted area. However, the ACS does not track when the person leaves each visited restricted area within the given time period.

Another conventional ACS employs beacons and wireless communication devices (e.g., mobile phones) which communicate via Bluetooth technology. A personal identifier is stored on the wireless communication device, and communicated to the beacon when the person is in proximity thereto. In response to the reception of the personal identifier, the ACS would allow the person to have access to the restricted area.

SUMMARY OF THE INVENTION

The present invention concerns implementing systems and methods for controlling access to a restricted area. The methods involve: determining whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device disposed within the WAS. This determination may also be made based on at least one of a detected direction of the person's motion and a detected speed of the person's motion. Notably, the energy harvesting circuit of the WAS collects energy from an electromagnetic field emitted from access control communications equipment disposed at an access point to one or more restricted areas.

When a determination is made that the person desires to enter or exit the restricted area and/or the personal identification information of the WAS is verified, a mechanical actuator is actuated so as to enable the person's entrance into or exit from the restricted area. Subsequently, information is stored in a data store. The information can include, but is not limited to, a unique identifier and information indicating that the person entered or exited the restricted area at a particular time. The stored information may then be used in a historical analysis of the person's movement through a facility.

When a determination is made that the person does not desire to enter or exit the restricted area, information is also stored in the data store. The information includes, but is not limited to, the unique identifier and information indicating that the person passed by an access point of the restricted area but did not enter or exit the restricted area. The stored information may subsequently be used in the historical analysis of the person's movement through the facility.

In some scenarios, the methods further involve: receiving the unique identifier obtained from the WAS; determining whether the person is authorized to access the restricted area using the unique identifier; and causing actuation of the mechanical actuator when a determination is made that the person is authorized to access the restricted area and the determination is made that the person desires to enter the restricted area. The unique identifier is obtained from a signal transmitted from the WAS. The signal may be transmitted from the WAS in response to an interrogation signal transmitted from a reader disposed at an access point of the restricted area. Alternatively, the signal is transmitted from the WAS in response to the transitioning of the WAS from an energy harvesting mode to a communication mode. This mode transition occurs when the energy storage device is charged to an operating voltage level of a communication device disposed in the WAS.

DESCRIPTION OF THE DRAWINGS

Embodiments will be described with reference to the following drawing figures, in which like numerals represent like items throughout the figures, and in which.

DETAILED DESCRIPTION OF THE INVENTION

Figure 1:
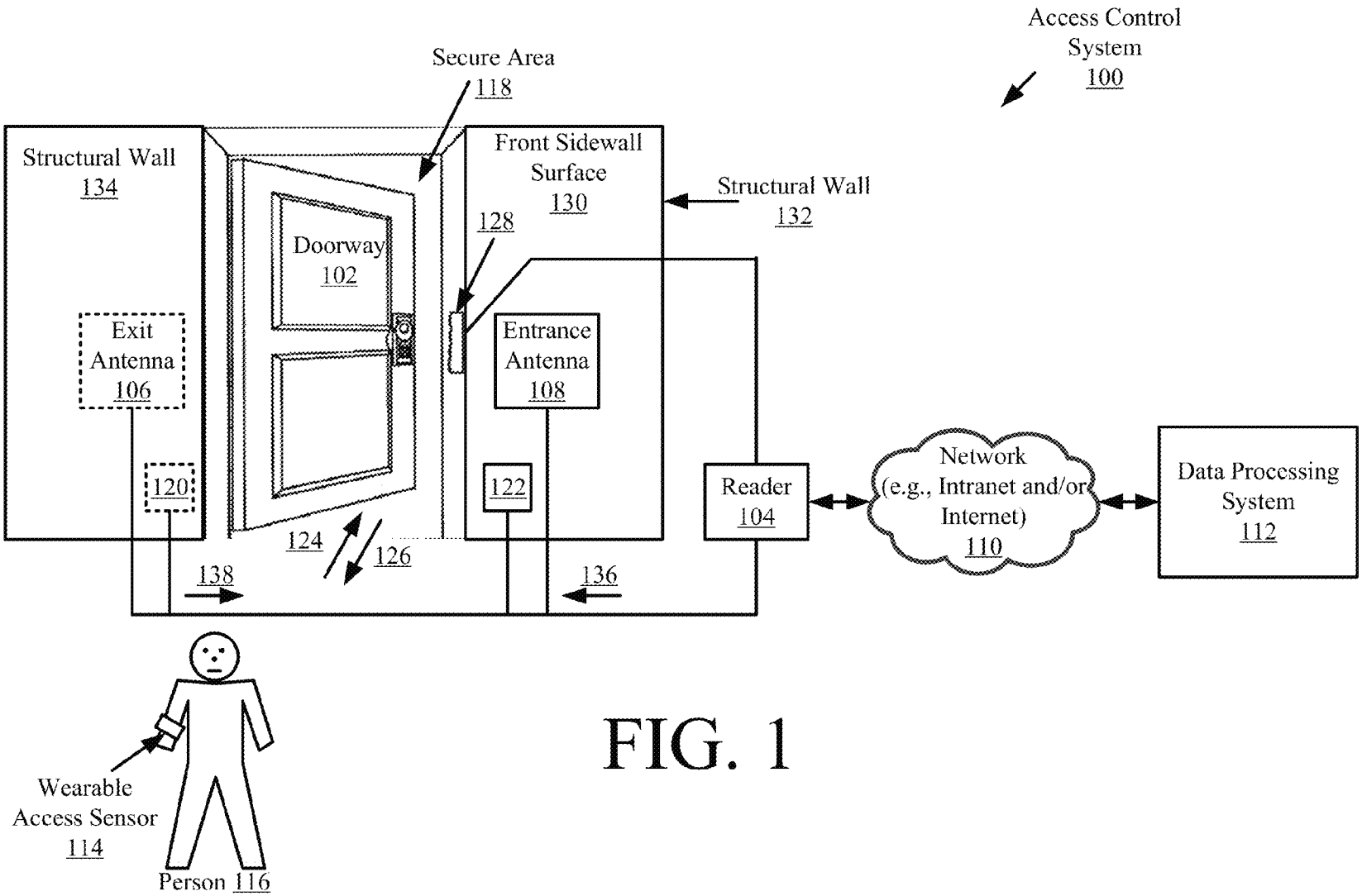
FIG. 1 is a perspective view of an exemplary ACS that is useful for understanding the present invention.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

As used in this document, the singular form "a", "an", and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to".

The present invention provides a novel ACS implementing a method for controlling access to restricted areas. An exemplary architecture 100 for the novel ACS is provided in FIG. 1. As shown in FIG. 1, ACS 100 is generally configured to manage the entrance and exit of people through at least one secure area 118. In this regard, each secure area is entered and exited via an access point, such as a doorway 102. Exit and entrance antennas 106, 108 are disposed on front and back surfaces of the same structural wall or different structural walls located adjacent to the access point 102. For example, the entrance antenna 108 is disposed on a front sidewall surface 130 of a structural wall 132 located adjacent to the doorway 102. In contrast, the exit antenna 106 is disposed on a back sidewall surface (not shown in FIG. 1) of a structural wall 134 located adjacent to the doorway 102. The antennas 106, 108 are also communicatively coupled to a reader 104. The reader 104 is communicatively coupled to a Data Processing System ("DPS") 112 via a network (e.g., an Intranet and/or an Internet).

A WAS 114 is assigned to each individual authorized for accessing restricted areas of a business entity. The WAS 114 comprises a wearable communications device that can be worn by the person 116 to which it is assigned. As shown in FIG. 1, WAS 114 comprises a wrist band with internal sensor circuitry (not shown in FIG. 1). The present invention is not limited in this regard. WAS 114 can include any other type of wearable item, such as a watch, necklace, hat or clip-on item which can be worn on a person or on a person's clothing at a location offset from the person's center axis. In all scenarios, the WAS 114 facilitates the entrance and exit of the authorized person through the secure area 118.

Figure 2:
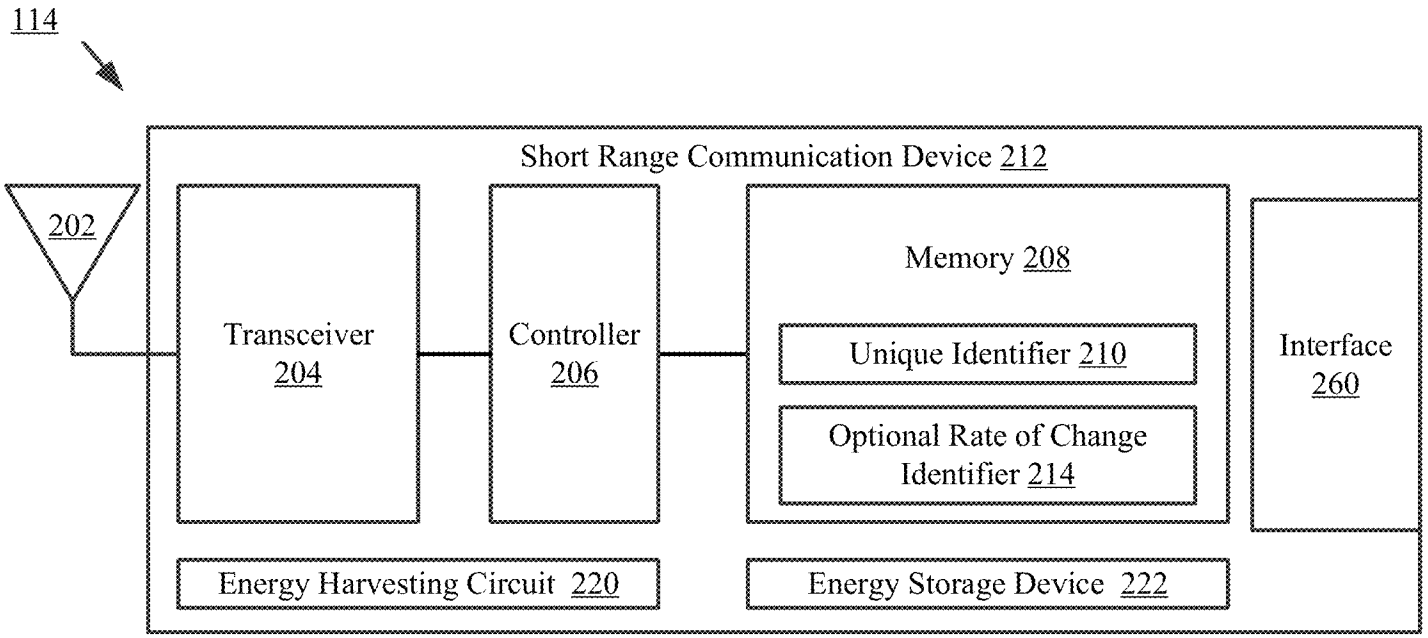
FIG. 2 is a block diagram of an exemplary architecture for the WAS of FIG. 1.

A schematic illustration of an exemplary architecture for the sensor circuitry of WAS 114 is provided FIG. 2. As shown in FIG. 2, the sensor circuitry comprises an energy harvesting circuit 220 for deriving energy from an external source to power other electronic components 204, 206, 208, 260 internal to WAS 114. The energy is collected from an electromagnetic field emitted within a surrounding environment from equipment disposed at an access point of a restricted area. The energy is stored in an energy storage device 222 (e.g., a capacitor) for later use in electronic components 204, 206, 208, 260. The energy storage device 222 accumulates charge as it is carried from one access point to another access point within a facility.

Figure 5:
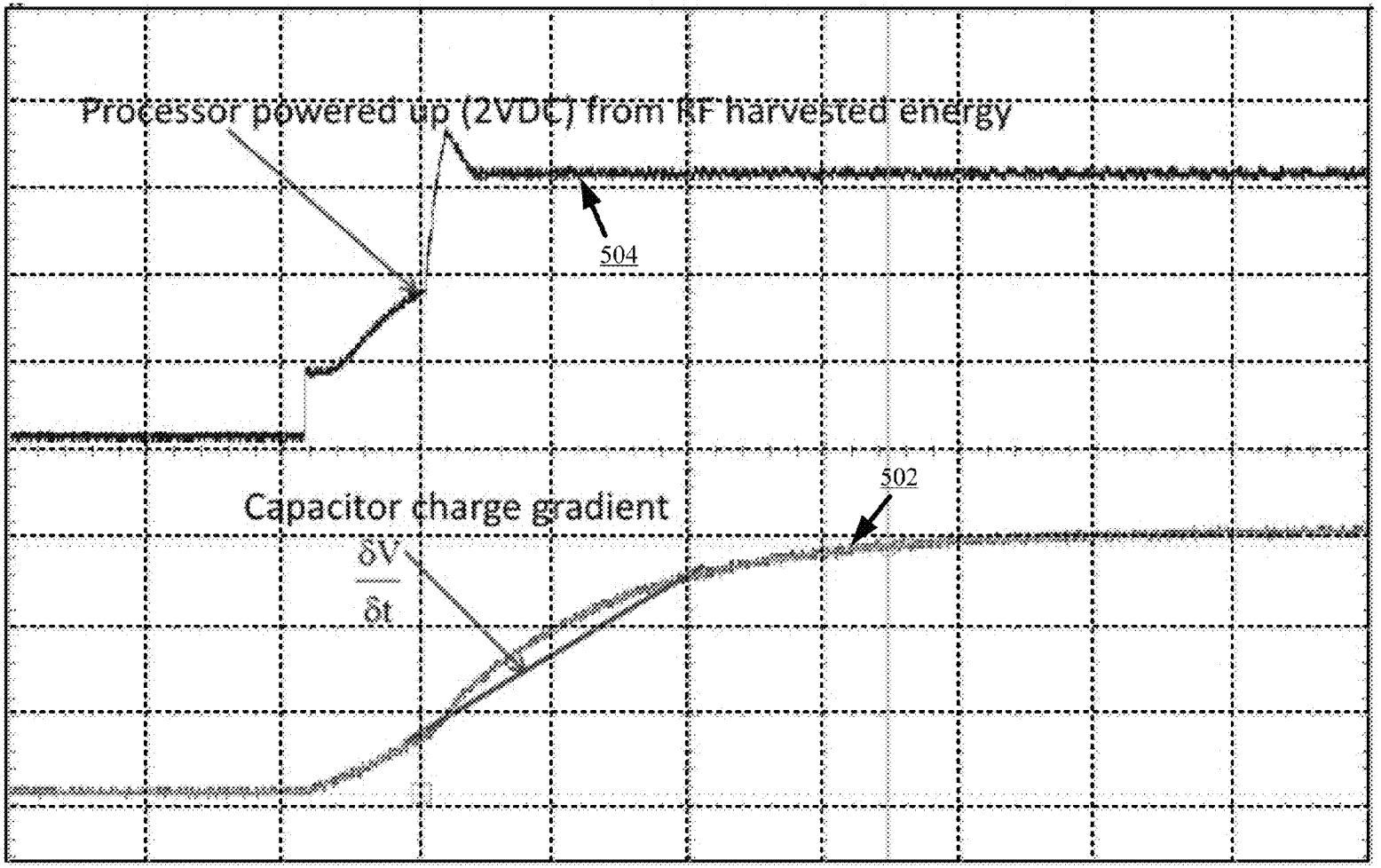
FIG. 5 is a graph illustrating the collection of energy by an energy harvesting device as it travels closer to an access point of a restricted area.

A graph 502 is provided in FIG. 5 that illustrates the collection of energy by the energy harvesting circuit 220 as the person travels closer to an access point of a restricted area. FIG. 5 also includes a graph 504 illustrating the supply of power to a processor of the WAS 114. When the processor is supplied power, the WAS 114 begins collecting data specifying the rate of energy storage by the energy storage device 222.

Referring again to FIG. 2, the antenna 202 of WAS 114 may comprise a directional antenna arranged to point away from the person's body when the WAS 114 is being worn thereby. The antenna 202 is coupled to a Short Range Communication ("SRC") device 212 implementing SRC technology. The SRC technology includes, but is not limited to, Radio Frequency Identification ("RFID") technology which uses radio-frequency electromagnetic fields to identify persons and/or objects when they come close to the reader 104. Accordingly, the SRC device 212 facilitates communication of a unique identifier 210 to the reader 104 via SRC reply signals in response to interrogation signals sent from reader 104. The unique identifier 210 is then used by the reader 104 and/or DPS 112 to automatically identify the person 116 which is in proximity to the access point 102 and/or whether the person is authorized to access the restricted area.

At the access point 102, the reader 104 determines the directionality of the WAS 114 emitting the SRC reply signal. This determination is made based on RSSI measurements of the power present in the SRC reply signal received by an antenna 106 or 108 from the WAS 114. The RSSI measurements specify the signal strength of the SRC reply signal received at antenna 106 or antenna 108, and whether the signal strength is increasing or decreasing during a given period of time. If the signal strength of the SRC reply signal is increasing during the given period of time, then the WAS 114 is deemed to be traveling towards to the respective antenna 106 or 108. In contrast, if the signal strength of the SRC reply signal is decreasing during the given period of time, then the WAS 114 is deemed to be traveling away from the respective antenna 106 or 108.

However, such determinations are not sufficient to detect whether the person is attempting to enter or exit the restricted area. Accordingly, additional motion sensors 120, 122 are employed herein. The motion sensors may be provided at the access point 102. A first motion sensor 122 is disposed on the front sidewall surface 130 of the structural wall 132 located adjacent to the access point 102. In contrast, a second motion sensor 122 is disposed on a back sidewall surface (not shown in FIG. 1) of the structural wall 134 located adjacent to the access point 102. The motion sensors 120, 122 are used to determine the direction and/or speed/velocity of travel of the person 116 in proximity to the access point 102. Information specifying the person's direction and/or speed/velocity of travel is provided from the motion sensors 120, 122 to the reader 104.

Notably, the present invention is not limited to the motion sensor configuration shown in FIG. 1. Additionally or alternatively, the motion sensors provided in wireless communication devices (e.g., mobile phones or smart phones) can be used to detect the direction and/or velocity of the person's motion.

In turn, the reader 104 forwards the information received from the motion sensor(s) 120, 122 to the DPS 112 via network 110. Similarly, reader 104 communicates information to the DPS 112 indicating the directionality of the WAS 114 (i.e., whether the WAS 114 is traveling towards or away from the antenna 106 or 108). The DPS 112 may be located in the same facility as the reader 104 or in a different facility remote from the facility in which the reader 104 is disposed. As such, the network 110 may comprise an Intranet and/or the Internet. Additionally, each exit and/or entrance to a restricted area in each facility of a business entity may have access control sensory systems 104-108, 120, 122 disposed thereat so as to define a distributed network of access control sensor systems.

At the DPS 112, the information is used to determine whether or not the person is attempting to enter or exit the access point 102. For example, if the information indicates that the WAS 114 is traveling towards the entrance antenna 108 and the person is moving in direction 124, then a determination is made that the person desires to enter the restricted area via access point 102. In contrast, if the information indicates that the WAS 114 is traveling towards antenna 106 and the person is moving in direction 126, then a determination is made that the person desires to exit the restricted area via the access point 102. If the information indicates that the WAS 114 is traveling away from the antenna 108, then a determination is made that the person is not trying to enter the restricted area. Similarly, if the information indicates that the WAS 114 is traveling away from the antenna 106, then a determination is made that the person is not trying to exit the restricted area.

The DPS 112 may also analyze patterns of motion defined by the information to determine whether or not the person desires to enter or exit the access point 102. For example, if the information indicates that the person 116 is traveling in a direction 124, 136 or 138 towards the access point 102 during a first period of time and then travels in a direction 126, 136 or 138 away from the access point 102 during an immediately following second period of time, then a determination is made that the person does not want to gain access to the restricted area, but is simply passing by the access point. In contrast, if the information indicates that the person 116 is traveling at a first speed in a direction 124, 136 or 138 towards the access point 102 during a first period of time and then slows down as (s)he approaches the access point, a determination is made that the person does want to gain access to the restricted area. Similarly, if the information indicates that the person 116 is traveling at a first speed in a direction 124, 136 or 138 towards the access point 102 during a first period of time and stops upon reaching the access point, a determination is made that the person does want to gain access to the restricted area.

Upon determining that the person does not want to enter or exit the restricted area, the DPS 112 simply logs the unique identifier, the directionality information, the motion direction information, the speed/velocity information, and/or the results of the information analysis in a data store (not shown in FIG. 1) for later use. Upon determining that the person does want to enter the restricted area, the DPS 112 compares the unique identifier 210 to a plurality of unique identifiers stored in the data store to check whether the person is authorized to enter the restricted area. If the person is authorized to enter the restricted area, the DPS 112 causes a door opening actuator 128 to be actuated (e.g. for unlocking a lock). The DPS 112 also logs results of the information analysis and/or information specifying that access to the restricted area was provided to the person at a particular time. Upon determining that the person wants to exit the restricted area, the DPS 112 causes a door opening actuator 128 to be actuated, and also logs results of the information analysis and/or information specifying that the person exited the restricted area at a particular time.

The data logging allows the DPS 112 to track the access points through which the person enters and exits, and the time of such entering and exiting. This historical information is useful for a variety of reasons. For example, the historical information can be used to determine when employees arrive at and/or leave work, whereby the need for conventional employee time-attendance systems requiring each employee to manually clock-in upon arrival at work and clock-out upon leaving work is no longer necessary. The historical information can also be used to identify individuals who gained access to a restricted area when a possible theft occurred or when equipment was removed from the restricted area.

Notably, the above described access control system overcomes certain drawbacks of conventional access control systems. For example, in the present invention, authorized individuals do not need to take any manual actions (e.g., swiping a card) to gain access to restricted areas. In effect, the need for certain access control equipment (e.g., card readers) has been eliminated, thereby reducing the overall cost of implementing the present access control system 100.

In other scenarios, the WAS 114 operates in both an energy harvesting mode and a communications mode. In the energy harvesting mode, the energy harvesting circuit 220 collects energy every time WAS 114 passes by an access point. The collected energy is stored in the energy storage device 222 (e.g., a capacitor). Once the energy storage device 222 is charged to an operating voltage level of the SRC device 212, the mode of the WAS 114 is changed from the energy harvesting mode to the communications mode. Thereafter, an SRC identifier signal is sent to the reader 104 via antenna 202 at the access point 102. The SRC identifier signal comprises the unique identifier 210. Information 214 indicating the rate of change of the charging voltage of the energy storage device 222 (e.g., a capacitor) may also be sent from the WAS 114 to the reader 104 via the SRC identifier signal. The rate of change information 214 specifies directionality of the WAS 114. At a later time, the reader 104 communicates the unique identifier 210 and/or rate of change information 214 to the DPS 112.

Notably, the motion sensors 120, 122 are also employed along with the multi-mode WAS 114 (i.e., the WAS configured to operate in both an energy harvesting mode and a communications mode). The motion sensors 120, 122 are used to determine the direction and/or speed/velocity of travel of the person 116 in proximity to the access point 102. Information specifying the person's direction and/or speed/velocity of travel is provided from the motion sensors 120, 122 to the reader 104.

At the DPS 112, a determination is made as to whether the person is authorized to access the restricted area based on the unique identifier 210 and/or whether the person is attempting to enter or exit the restricted area based on the rate of change information 214. If the person is attempting to enter the restricted area and is not authorized to access the restricted area, then the DPS 112 simply logs information indicating that the person was in proximity of the access point at a particular time. In contrast, if the person is attempting to enter the restricted area and is authorized to access the restricted area, then the DPS 112 causes the door opening actuator 128 to be actuated. The DPS 112 also logs information specifying that access to the restricted area was provided to the person at a particular time.

In this scenario, the reader 104 is simply an edge connect module that controls the door opening actuator. As a result, the need for an interrogation reader (e.g., an RFID reader) is eliminated, thereby reducing the overall cost required to implement system 100.

Figure 3A:
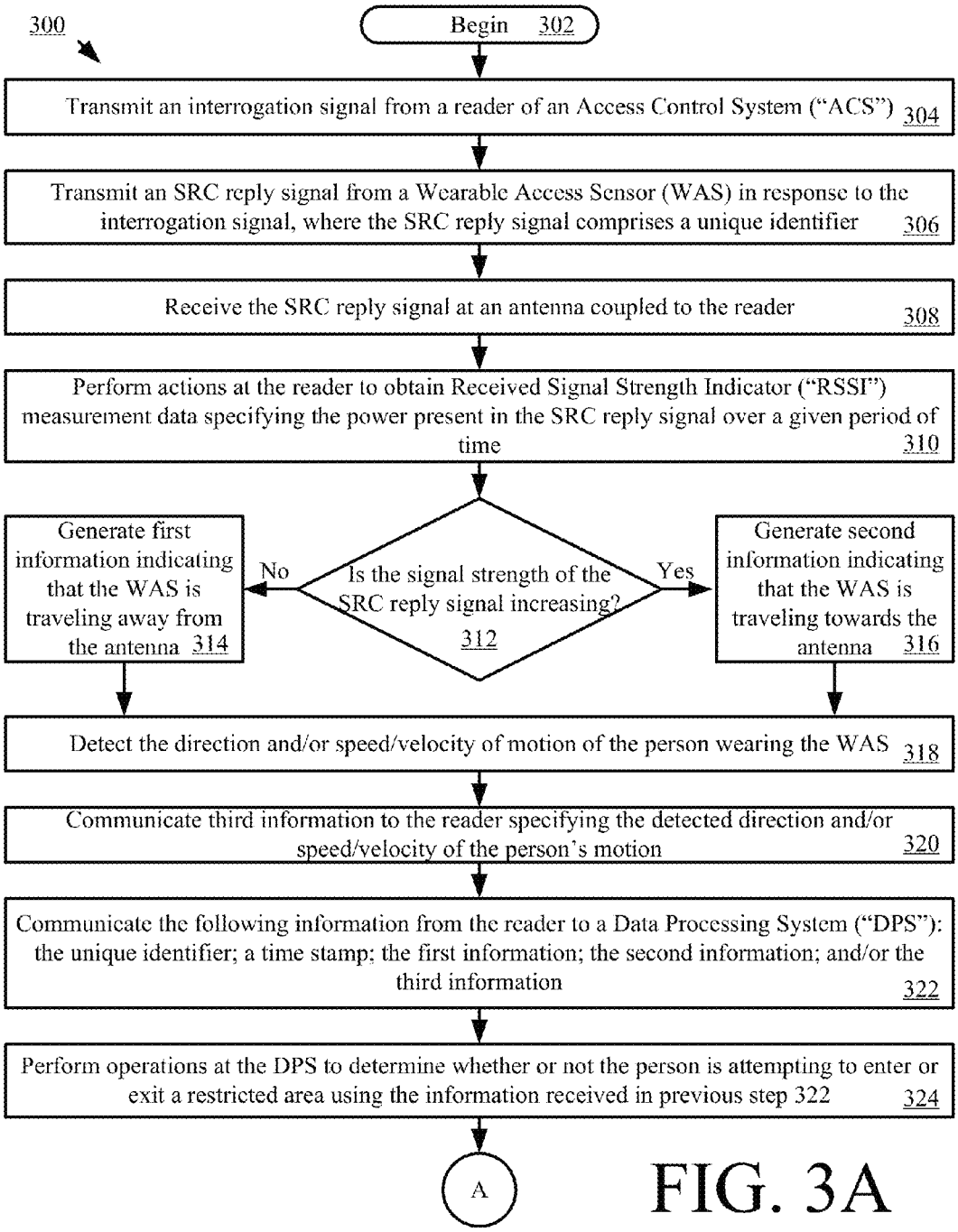
FIGS. 3A-3B collectively provide a flow diagram of an exemplary method for controlling access to a restricted area.
Figure 3B:
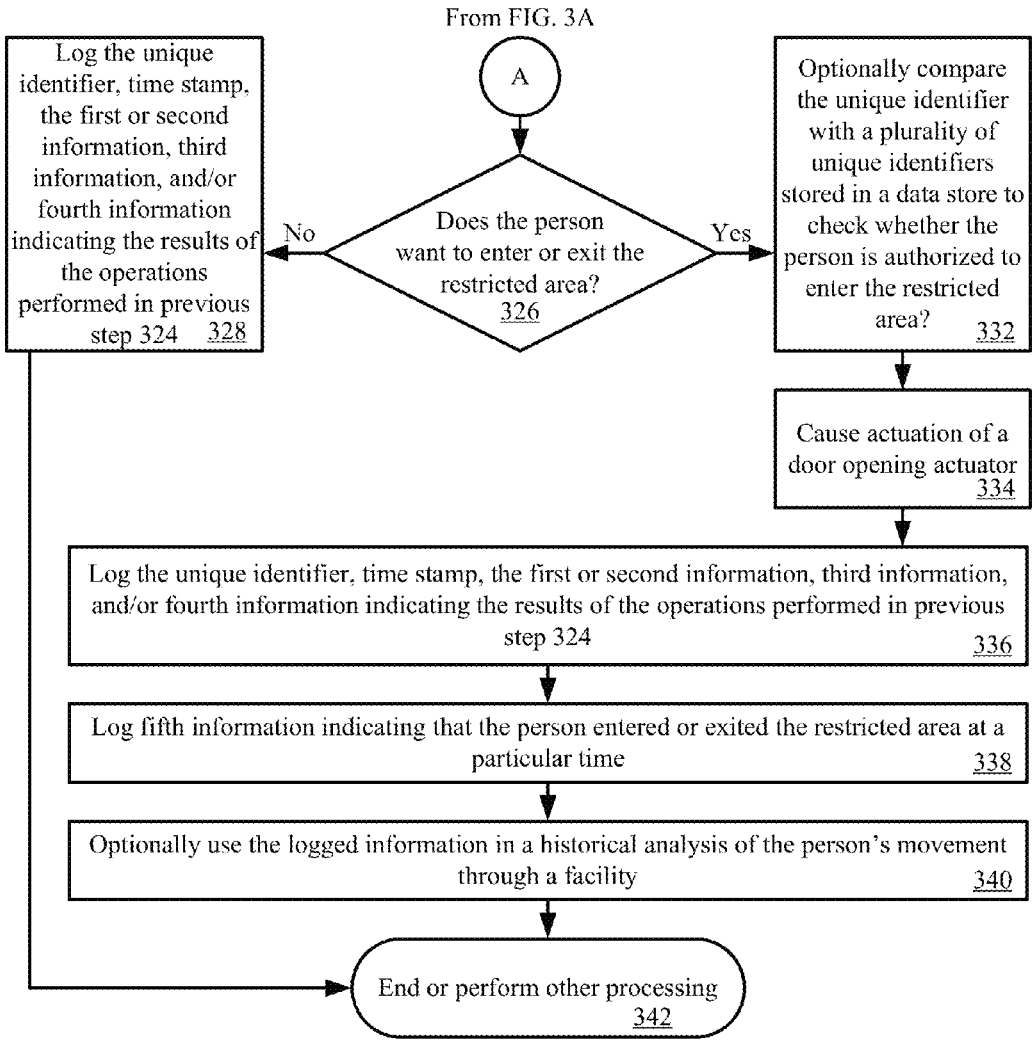

Referring now to FIGS. 3A-3B, there is provided a flow diagram of an exemplary method 300 for controlling access to a restricted area. As shown in FIG. 3A, method 300 begins with step 302 and continues with step 304 where an interrogation signal is transmitted from a reader (e.g., reader 104 of FIG. 1) of an ACS (e.g., ACS 100 of FIG. 1). In response to the interrogation signal, an SRC reply signal is transmitted from a WAS (e.g., WAS 114 of FIG. 1), as shown by step 306. The SRC reply signal comprises a unique identifier (e.g., unique identifier 210 of FIG. 2). In next step 308, the SRC reply signal is received at an antenna (e.g., antenna 106 or 108 of FIG. 1) coupled to the reader.

At the reader, actions are performed to obtain RSSI measurement data specifying the power present in the SRC reply signal over a given period of time, as shown by step 310. The RSSI measurement data is used by the reader to determine if the signal strength of the SRC reply message is increasing. Notably, this determination can alternatively be performed by a DPS (e.g., DPS 112 of FIG. 1). In this case, method 300 can be amended accordingly. Such changes are understood by persons skilled in the art.

If the signal strength of the SRC reply signal is decreasing [312:NO], then step 314 is performed where first information is generated indicating that the WAS is traveling away from the antenna. In contrast, if the signal strength of the SRC reply signal is increasing [312:YES], then step 316 is performed where second information is generated indicating that the WAS is traveling towards the antenna.

Upon completing step 314 or 316, the method 300 continues with step 318. Step 318 involves detecting the direction and/or speed/velocity of motion of the person (e.g., person 116 of FIG. 1) wearing the WAS. One or more motion sensors (e.g., sensors 120 and/or 122 of FIG. 1) can be used in step 318 for said detection. Thereafter in step 320, third information is communicated to the reader specifying the detected direction and/or speed/velocity of the person's motion. The reader then communicates the following information to the DPS: the unique identifier; a time stamp; the first information; the second information; and/or the third information, as shown by step 322.

At the DPS, operations are performed to determine whether or not the person is attempting to enter or exit the restricted area using the information received in previous step 322. For example, if the received information indicates that the WAS is traveling towards an entrance antenna (e.g., antenna 108 of FIG. 1) and the person is moving in a first direction (e.g., direction 124 of FIG. 1), then a determination is made that the person desires to enter the restricted area via an access point (e.g., access point 102 of FIG. 1). In contrast, if the received information indicates that the WAS is traveling towards an exit antenna (e.g., antenna 106 of FIG. 1) and the person is moving in a direction opposite the first direction (e.g., direction 126 of FIG. 1), then a determination is made that the person desires to exit the restricted area via the access point. If the received information indicates that the WAS is traveling away from the entrance antenna, then a determination is made that the person is not trying to enter the restricted area. Similarly, if the received information indicates that the WAS is traveling away from the exit antenna, then a determination is made that the person is not trying to exit the restricted area. The present invention is not limited to the particulars of these examples. In this regard, it should be understood that the DPS additionally or alternatively analyzes patterns of motion defined by the received information to determine whether or not the person desires to enter or exit the access point.

After completing step 322, method 300 continues with decision step 324 of FIG. 3B. If it is determined that the person does not want to enter or exit the restricted area [326: NO], then step 328 is performed where the following information is logged in a data store: the unique identifier; a time stamp; the first or second information; the third information; and/or the fourth information indicating the results of the operations performed in previous step 324. Subsequently, step 342 is performed where method 300 ends or other processing is performed.

If it is determined that the person does want to enter or exit the restricted area [326:YES], then optional step 332 is performed. Optional step 332 is performed when the person is attempting to enter the restricted area, and therefore involves comparing the unique identifier with a plurality of unique identifiers stored in a data store to check whether the person is authorized to enter the restricted area. When a person is attempting to exit the restricted area or an authorized person is attempting to enter the restricted area, the DPS performs actions to cause actuation of a door opening actuator (e.g., door opening actuation 128 of FIG. 1) as shown by step 334. Upon completing step 334, steps 336-338 are performed to log the following information: the unique identifier; the time stamp; the first or second information; the third information; the fourth information; and/or fifth information indicating that the person entered or exited the restricted area at a particular time. The logged information can optionally be used in step 340 to perform a historical analysis of the person's movement through a facility. Thereafter, step 342 is performed where method 300 ends or other processing is performed.

Figure 4A:
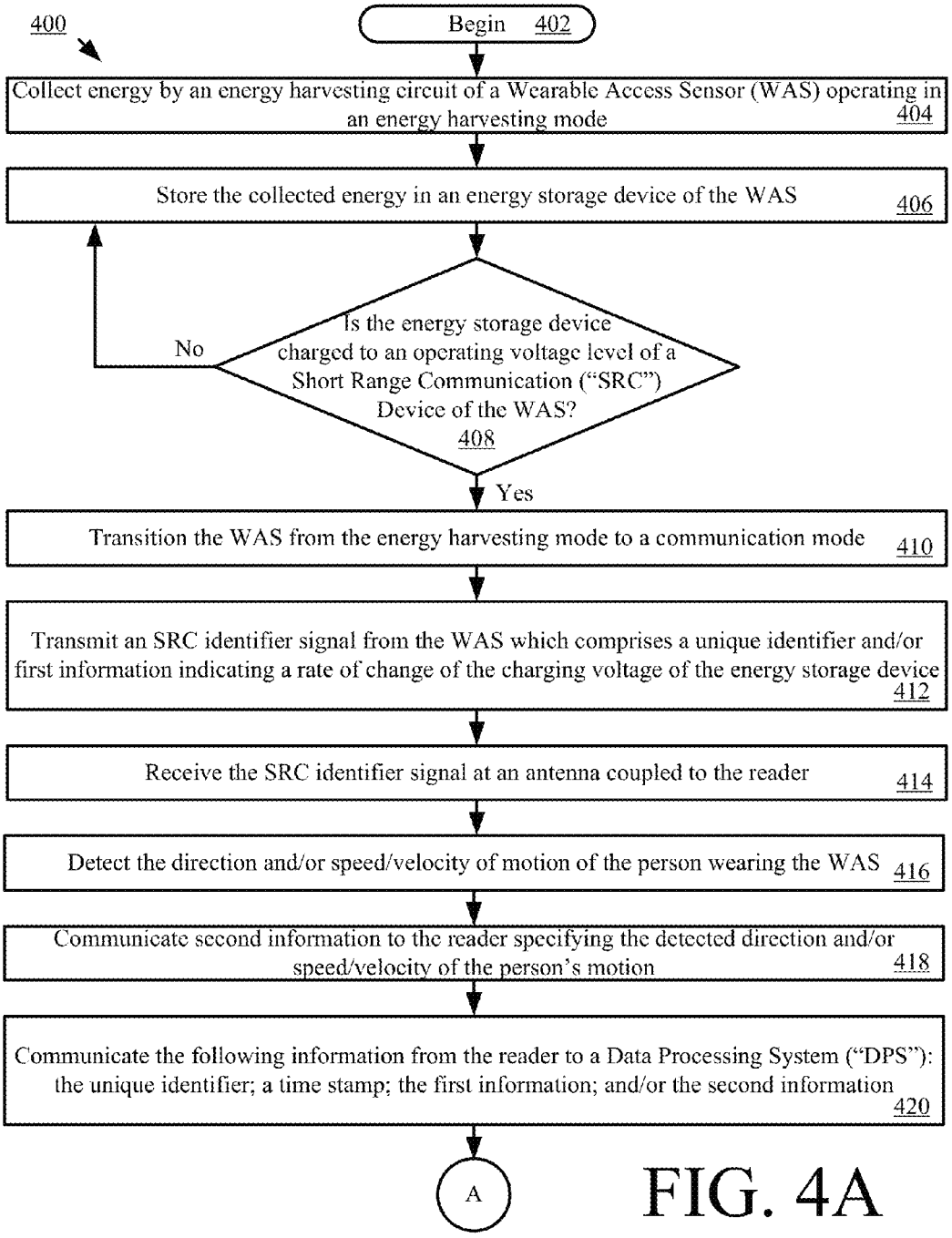
FIGS. 4A-4B collectively provide a flow diagram of another exemplary method for controlling access to a restricted area.
Figure 4B:
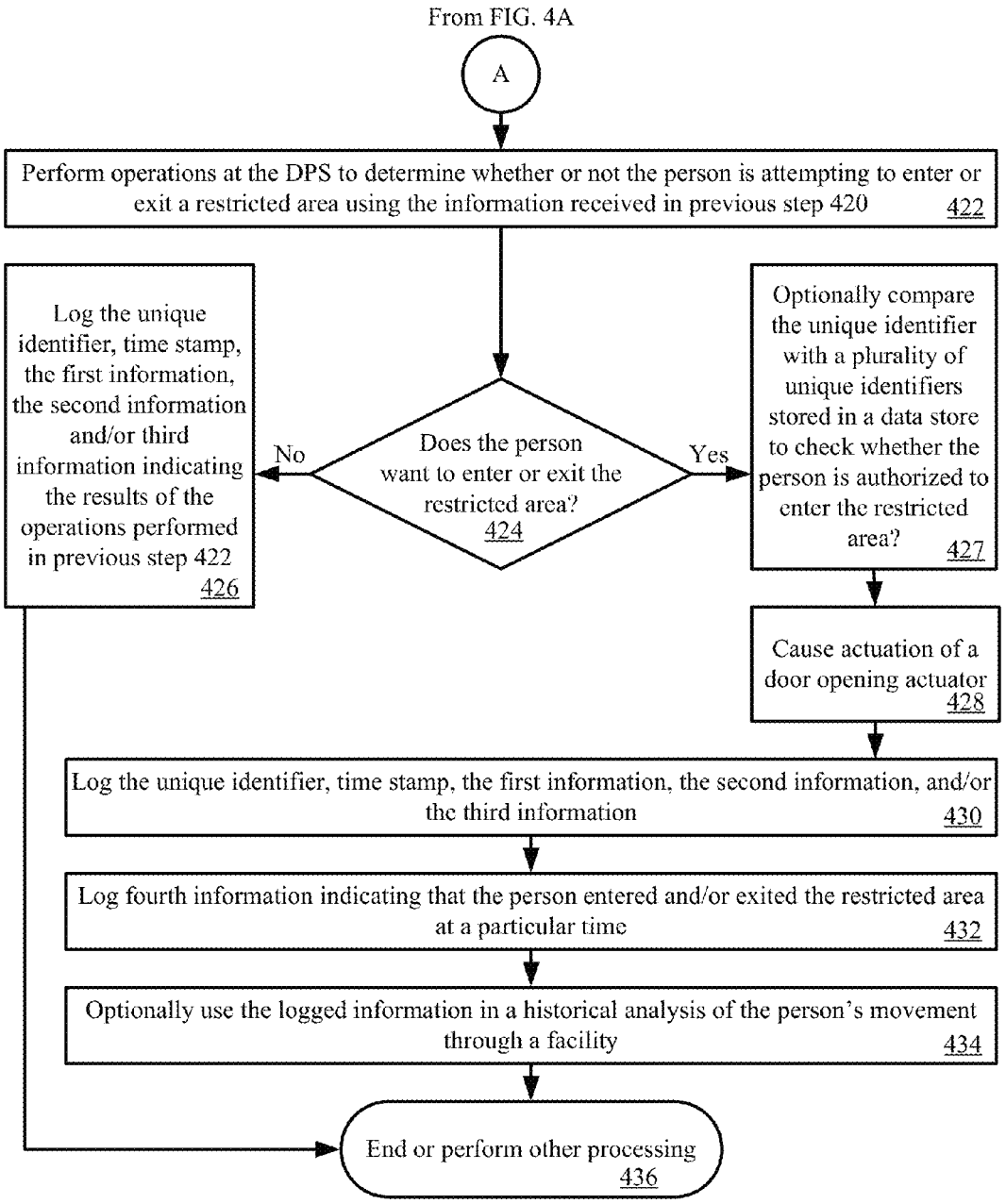

Referring now to FIGS. 4A-4B, there is provided a flow diagram of another exemplary method 400 for controlling access to a restricted area. As shown in FIG. 4A, method 400 begins with step 402 and continues with step 404 where an energy harvesting circuit (e.g., circuit 220 of FIG. 2) of a WAS (e.g., WAS 114 of FIG. 1) collects energy. The collected energy is then stored in an energy storage device (e.g., device 222 of FIG. 2) of the WAS. When the energy storage device charges to an operating voltage level of an SRC device (e.g., SRC device 212 of FIG. 2) of the WAS [408:YES], step 410 is performed where the WAS is transitioned from its energy harvesting mode to its communication mode. In its communication mode, step 412 is performed. Step 412 involves transmitting an SRC identifier signal from the WAS. The SRC identifier signal comprises a unique identifier and/or first information indicating a rate of change of the charging voltage of the energy storage device. The SRC identifier signal is then received in step 414 at an antenna (e.g., antenna 106 or 108 of FIG. 1) coupled to the reader.

In a next step 416, the direction and/or speed/velocity of motion of the person wearing the WAS is detected. One or more motion sensors (e.g., sensors 120 and/or 122 of FIG. 1) can be used in step 416 for said detection. Thereafter in step 418, second information is communicated to the reader specifying the detected direction and/or speed/velocity of the person's motion. The reader then communicates the following information to the DPS: the unique identifier; a time stamp; the first information; and/or the second information, as shown by step 420. After completing step 420, method 400 continues with step 422 of FIG. 4B.

At the DPS, operations are performed in step 422 to determine whether or not the person is attempting to enter or exit the restricted area using the information received in previous step 420. For example, if the received information indicates that the WAS is traveling towards an entrance antenna (e.g., antenna 108 of FIG. 1) and the person is moving in a first direction (e.g., direction 124 of FIG. 1), then a determination is made that the person desires to enter the restricted area via an access point (e.g., access point 102 of FIG. 1). In contrast, if the received information indicates that the WAS is traveling towards an exit antenna (e.g., antenna 106 of FIG. 1) and the person is moving in a direction opposite the first direction (e.g., direction 126 of FIG. 1), then a determination is made that the person desires to exit the restricted area via the access point. If the received information indicates that the WAS is traveling away from the entrance antenna, then a determination is made that the person is not trying to enter the restricted area. Similarly, if the received information indicates that the WAS is traveling away from the exit antenna, then a determination is made that the person is not trying to exit the restricted area. The present invention is not limited to the particulars of these examples. In this regard, it should be understood that the DPS additionally or alternatively analyzes patterns of motion defined by the received information to determine whether or not the person desires to enter or exit the access point.

After completing step 422, method 400 continues with decision step 424 of FIG. 4B. If it is determined that the person does not want to enter or exit the restricted area [424: NO], then step 326 is performed where the following information is logged in a data store: the unique identifier; a time stamp; the first information; the second information; and/or the third information indicating the results of the operations performed in previous step 422. Subsequently, step 436 is performed where method 400 ends or other processing is performed.

If it is determined that the person does want to enter or exit the restricted area [424:YES], then optional step 427 is performed. Optional step 427 is performed when the person is attempting to enter the restricted area, and therefore involves comparing the unique identifier with a plurality of unique identifiers stored in a data store to check whether the person is authorized to enter the restricted area. When a person is attempting to exit the restricted area or an authorized person is attempting to enter the restricted area, the DPS performs actions to cause actuation of a door opening actuator (e.g., door opening actuation 128 of FIG. 1) as shown by step 428. Upon completing step 428, steps 430-432 are performed to log the following information: the unique identifier; the time stamp; the first information; the second information; the third information; and/or the fourth information indicating that the person entered or exited the restricted area at a particular time. The logged information can optionally be used in step 434 to perform a historical analysis of the person's movement through a facility. Thereafter, step 436 is performed where method 400 ends or other processing is performed.

Additionally, in some scenarios, the WAS may detect no rate of change when the wearer is standing near the access point of a restricted area. For example, let's assume that a person travels towards the access point whereby the WAS detects a rate of change of the energy collected by the energy harvesting circuit thereof. When the person arrives at the access point, (s)he is stopped by another person for a discussion. At this time, the WAS detects no rate of change of the energy collected by the energy harvesting circuit thereof. In response to such a detection, the WAS communicates a signal to the reader (e.g., reader 104 of FIG. 1) indicating that there is currently no change in the rate at which the energy harvesting circuit is collecting energy. In turn, the reader performs operations to cause termination of the emission of an electromagnetic field from the entrance antenna (e.g., antenna 108 of FIG. 1). The electromagnetic field is once again emitted upon the expiration of a pre-defined period of time (e.g., 2 minutes). In this way, the person may still obtain access to the restricted area after finishing said discussion with the other person.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

The features and functions disclosed above, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

We claim:

1. A method for controlling access to a restricted area, comprising:

determining, by an electronic circuit, whether a person desires to enter or exit the restricted area based on (1) a directionality of a Wearable Access Sensor ("WAS") worn by the person which is determined based on (a) Received Signal Strength Indicator ("RSSI") measurement data specifying a power present in a signal received from the WAS or (b) rate of change data specifying a rate of change of a charging voltage of an energy storage device used in an electromagnetic field energy harvesting circuit disposed within the WAS, and (2) a direction and speed of the person's motion; and causing, by the electronic circuit, actuation of a mechanical actuator to enable the person's entrance into or exit from the restricted area when a determination is made that the person desires to enter or exit the restricted area.

2. The method according to claim 1, further comprising transmitting the signal from the WAS in response to an interrogation signal transmitted from a reader disposed at an access point of the restricted area.

3. A method for controlling access to a restricted area, comprising:

determining, by an electronic circuit, whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device used in an electromagnetic field energy harvesting circuit disposed within the WAS;

causing, by the electronic circuit, actuation of a mechanical actuator to enable the person's entrance into or exit from the restricted area when a determination is made that the person desires to enter or exit the restricted area; and transitioning the WAS from an energy harvesting mode to a communication mode when the energy storage device is charged to an operating voltage level of a communication device disposed in the WAS.

4. The method according to claim 3, further comprising transmitting the signal from the WAS in response to the transitioning of the WAS to the communication mode.

5. The method according to claim 1, wherein the determining step is based further on at least one of a detected direction of the person's motion and a detected speed of the person's motion.

6. The method according to claim 1, further comprising storing the unique identifier and information indicating that the person entered or exited the restricted area at a particular time subsequent to said actuation of the mechanical actuator.

7. The method according to claim 6, further comprising using the unique identifier and the information in a historical analysis of the person's movement through a facility.

8. A method for controlling access to a restricted area, comprising:

receiving, by an electronic circuit, a unique identifier obtained from a Wearable Access Sensor ("WAS") worn by a person;

determining whether the person is authorized to access the restricted area using the unique identifier;

determining, by an electronic circuit, whether the person desires to enter or exit the restricted area based on (1) Received Signal Strength Indicator ("RSSI") measurement data specifying a power present in a signal received from the WAS or (2) rate of change data specifying a rate of change of a charging voltage of an energy storage device used in an electromagnetic field energy harvesting circuit disposed within the WAS;

causing, by the electronic circuit, actuation of a mechanical actuator to enable the person's entrance into the restricted area when a determination is made that the person desires to enter the restricted area and when a determination is made that the person is authorized to access the restricted area.

9. A method for controlling access to a restricted area, comprising:

determining, by an electronic circuit, whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device used in an electromagnetic field energy harvesting circuit disposed within the WAS;

causing, by the electronic circuit, actuation of a mechanical actuator to enable the person's entrance into or exit from the restricted area when a determination is made that the person desires to enter or exit the restricted area; and storing the unique identifier and information indicating that the person passed by an access point of the restricted area but did not enter or exit the restricted area, when a determination is made that the person does not desire to enter or exit the restricted area.

10. A method for controlling access to a restricted area, comprising:

determining, by an electronic circuit, whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device used in an electromagnetic field energy harvesting circuit disposed within the WAS;

causing, by the electronic circuit, actuation of a mechanical actuator to enable the person's entrance into or exit from the restricted area when a determination is made that the person desires to enter or exit the restricted area; and collecting energy by the energy harvesting circuit of the WAS from an electromagnetic field emitted from access control equipment disposed at an access point to one or more restricted areas.

11. A system, comprising:

access control equipment at least partially disposed adjacent to an access point of a restricted area, the access control equipment determining whether a person desires to enter or exit the restricted area based on (1) a directionality of a Wearable Access Sensor ("WAS") worn by a person which is determined based on (a) Received Signal Strength Indicator ("RSSI") measurement data specifying a power present in a signal received from the WAS or (b) rate of change data specifying a rate of change of a charging voltage of an energy storage device disposed within the WAS, and (2) a direction and speed of the person's motion, and causing actuation of a mechanical actuator to enable the person's entrance into or exit from the restricted area when a determination is made that the person desires to enter or exit the restricted area.

12. The system according to claim 11, wherein the signal is transmitted from the WAS in response to an interrogation signal transmitted from a reader disposed at the access point of the restricted area.

13. The system according to claim 11, wherein the determination as to whether a person desires to enter or exit the restricted area is further based on at least one of a detected direction of the person's motion and a detected speed of the person's motion.

14. The system according to claim 11, wherein the access control equipment further stores the unique identifier and information indicating that the person entered or exited the restricted area at a particular time subsequent to said actuation of the mechanical actuator.

15. The system according to claim 14, wherein the access control equipment further uses the unique identifier and the information in a historical analysis of the person's movement through a facility.

16. A system, comprising:

access control equipment at least partially disposed adjacent to an access point of a restricted area, the access control equipment receiving a unique identifier obtained from a Wearable Access Sensor ("WAS") worn by a person, determining whether the person is authorized to access the restricted area using the unique identifier, determining whether the person desires to enter or exit the restricted area based on (1) Received Signal Strength Indicator ("RSSI") measurement data specifying a power present in a signal received from the WAS or (2) rate of change data specifying a rate of change of a charging voltage of an energy storage device disposed within the WAS, causing actuation of a mechanical actuator to enable the person's entrance into the restricted area when a determination is made that the person desires to enter the restricted area and when a determination is made that the person is authorized to access the restricted area.

17. A system, comprising:

access control equipment at least partially disposed adjacent to an access point of a restricted area, the access control equipment determining whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device disposed within the WAS, and causing actuation of a mechanical actuator to enable the person's entrance into or exit from the restricted area when a determination is made that the person desires to enter or exit the restricted area;

wherein the WAS is transitioned from an energy harvesting mode to a communication mode when the energy storage device is charged to an operating voltage level of a communication device disposed in the WAS.

18. The system according to claim 17, wherein the signal is transmitted from the WAS in response to the transitioning of the WAS to the communication mode.

19. A system, comprising:

access control equipment at least partially disposed adjacent to an access point of a restricted area, the access control equipment determining whether a person desires to enter or exit the restricted area based on (1) Received Signal Strength Indicator ("RSSI") measurement data specifying a power present in a signal received from a Wearable Access Sensor ("WAS") worn by the person or (2) rate of change data specifying a rate of change of a charging voltage of an energy storage device disposed within the WAS, and causing actuation of a mechanical actuator to enable the person's entrance into or exit from the restricted area when a determination is made that the person desires to enter or exit the restricted area;

wherein the access control equipment further stores the unique identifier and information indicating that the person passed by an access point of the restricted area but did not enter or exit the restricted area, when a determination is made that the person does not desire to enter or exit the restricted area.

20. A Wearable Access Sensor ("WAS"), comprising:

an energy harvesting circuit harvesting energy from an electromagnetic field of a surrounding environment when the WAS is in an energy harvesting mode; and a communication device communicating information to or from an external device when the WAS is in a communication mode;

wherein the WAS is transitioned from the energy harvesting mode to the communication mode when an energy storage device is charged to an operating voltage level of the communication device.

* * * * *